US005228688A

United States Patent [19]

Davis

[11] Patent Number: 5,228,688

[45] Date of Patent: Jul. 20, 1993

[54] CONSTANT SWING GOLF CLUB SET

[76] Inventor: C. Michael Davis, 10 Midvale St., Greenville, S.C. 29615

[21] Appl. No.: 615,352

[22] Filed: Nov. 19, 1990

Related U.S. Application Data

[63] Continuation-in-part of Ser. No. 329,364, Mar. 27, 1989, Pat. No. 4,971,321.

[51] Int. Cl.[5] ..... A63B 53/00

[52] U.S. Cl. ..... 273/77 A; 273/81 A

[58] Field of Search ..... 273/77 A, 81 A, 81 D, 273/81 R, 80 B, 163 R, 167 G, 167 J, 165

[56] References Cited

U.S. PATENT DOCUMENTS

| | | | |
|---|---|---|---|
| 1,569,340 | 1/1926 | Vaile | 273/165 |
| 3,137,194 | 6/1964 | Simpson | 273/165 |
| 3,984,103 | 10/1976 | Nix | 273/77 A |
| 4,461,479 | 7/1984 | Mitchell | 273/77 A |
| 4,600,195 | 7/1986 | Hunter | 273/81 A |
| 4,679,791 | 7/1987 | Hull | 273/77 A |
| 4,784,390 | 11/1988 | Horgen | 273/77 A |
| 4,858,929 | 8/1989 | Long | 273/77 A |
| 4,887,815 | 12/1989 | Hughes et al. | 273/77 A |
| 4,971,321 | 11/1990 | Davis | 273/77 A |

*Primary Examiner*—V. Millin
*Assistant Examiner*—William M. Pierce
*Attorney, Agent, or Firm*—Cort Flint; Henry S. Jaudon

[57] ABSTRACT

A set of clubs which includes a first set of woods and a second set of irons. The iron set includes multiple subsets which have a common club head which is the same in weight, vertical face height and length, but different in loft angle and face width so that all the irons have the same face presentation. The clubs of each subset have the same shaft length, but different lengths from subset to subset. Each club has a common grip line and top grip line defining a common grip about which all of the irons and woods are gripped. This provides the same vertical hand height and a common stance and swing. Counterweights are disposed in spaces to increase club head speed and each subset has a different shaft length, total weight and counterweight and the same club head weight and swing weight. The wood set has the same grip line, swing weight and vertical hand height, but different loft angles, lengths and counterweights. The vertical hand height of the woods and the irons are the same as a result of changes in the lie angle of the clubs of each set.

12 Claims, 5 Drawing Sheets

FIG. 2
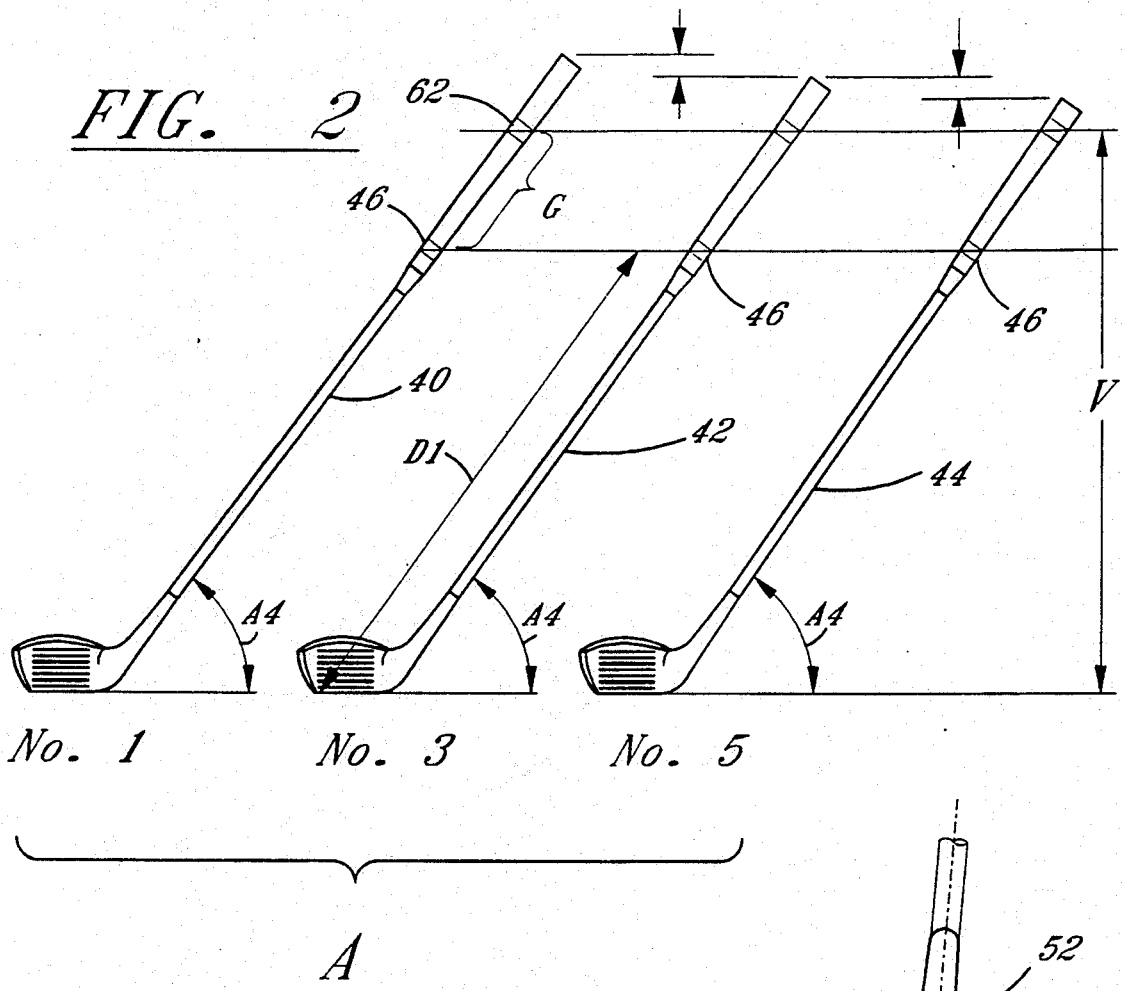
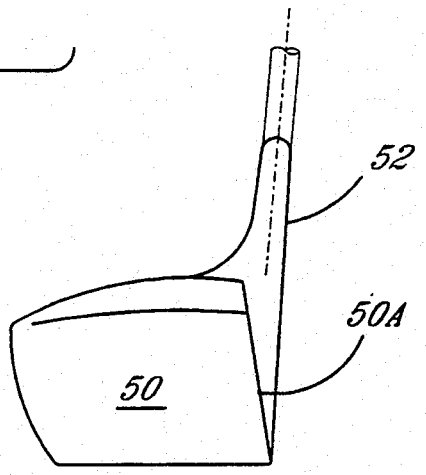
FIG. 6
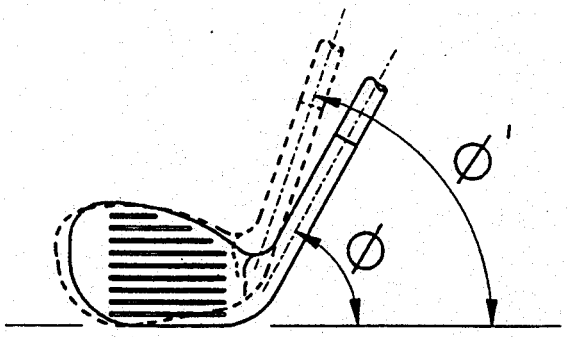
FIG. 3

CONSTANT SWING GOLF CLUB SET

BACKGROUND OF THE INVENTION

This is a continuation-in-part of application of copending U.S. application Ser. No. 07/329,364, filed Mar. 27, 1989, now U.S. Pat. No. 4,971,321, entitled CONSTANT SWING GOLF CLUB SET.

The invention relates to the game of golf, and particular, to a set of golf clubs in which all of the irons, as well as the woods, can be played with generally the same swing to hit the ball reliably yet with a range of distance equal to or greater than a conventional set of clubs.

Golf is becoming an even more popular sport and is being played by an increasing number of persons. It is estimated that there is now 23,000,000 golfers. However, ninety percent of the golfers shoot 85 and more, 7 percent of the golfers shoot between 82 and 85, 3 percent of the golfers shoot 82 and below, and only, 0.01 percent of the golfers shoot even par at 72. This raises the question of why only 3 percent of the golfers are able to consistently shoot below 82, and the fact that over 20 million golfers have a lot of room for improvement. One reason that only a few have been able to master the game is that the instructions received by the golfer may not best fit the golfer's style. It has been said that 6 different professional golfers would teach the game 6 different ways. Those who do play golf correctly cannot easily teach what they do to someone else. This is either because they do not know what they do or they cannot relate it to a student. The average golfer is prone to accept advise from a wide number of people with whom they play and golf becomes a trial and error game.

Another reason that instruction, advice, and practice have not been effective is that the conventional set of golf clubs basically has 13 different lengths, weights and sizes. Golf has been played almost 500 years with the golf clubs in a set being all different in shaft length, head weight, total weight, and lie. Each club has always required a different swing, and adding to the complexity of the game is that many instructors advocate a slightly different positioning of the ball relative to the feet for each different club. Thus, to master the game with the conventional set of clubs requires that the golfer develop 13 different swings, one for each club in the bag. Some instructors teach the idea of making a similar swing with every club. However, this is virtually impossible since all clubs differ in length, weight, and lie angle. When practicing a given iron at a practice range, it is quite common for the golfer to hit the ball well because of repeating the same swinging with the given iron. However, once he gets on the course and begins swinging differently for all of the clubs so the golfer loses the touch he had for making the good shots with the given iron.

In the conventional set of golf clubs, the clubs are matched which means that the woods and irons are of a specific swing weight, the shaft lengths are graduated, and there is a uniformity in the flexibility of the shafts. Graduated lengths of the clubs generally requires that the total weight to the clubs vary in order to obtain the equal swing weights. The effect of different shaft lengths and weights of the clubs is that a number of different muscle and body controls is needed in order for the player to learn to hit the different clubs in a consistent, effective manner.

In order to hit the golf ball with accuracy, the golf club head must be moved in a controlled arc that will bring it against the ball at the most effective striking angle with a velocity related to the distance the ball is to travel. The golf swing motion is so intricate that the greater part of the golfer's training is normally in swing control. However, if each club has a different shaft length, the plain of the arc swing will be different for each club. This means that the golfer must develop a different and body control discipline for each club, or 13 muscle and body control modes for a complete set of golf clubs.

The idea of a set of clubs in which all the clubs may be played with a consistent repeated swing has been around for a long time. The idea is based upon the premise that even an average golfer makes at least one shot in each round which is better than any professional golfer would have made from the same lie. The essential difference between professional and amateur golfers in making the good shot is repeating the swing time after time with very little margin of error. The professional does this because of the amounts of time spent in practicing the swings which the amateur is not able to do. Thus, it has been proposed to provide a set of golf clubs which can be played without a lot of variation in the swing of the clubs so that the average golfer may play more consistently. Only 1 repeating golf swing need be mastered and this swing is practiced any time any iron in the bag is shot. The longer you play the clubs, the more benefit you will receive by getting 13 times more practice on the individual repeated swings. Theoretically, one only needs take 1 iron to the practice range because they are all swung exactly alike.

U.S. Pat. No. 3,984,103 discloses a matched golf club set in which the irons, as well as the woods, have equal shaft length, equal lie angle, equal swing weight, and equal total weight. This set of clubs is said to provide a more consistent swing in accordance with the above objectives. However, the distance a ball is hit is generally determined by the club head weight and speed. Because the longer irons are shortened, the ability to hit the ball as far as conventional clubs is questionable, particularly for the driver and the longer irons. Since the only variations in the set of irons is the loft angle, the ability of the set of clubs to produce a range of distance comparable to a conventional set of clubs is highly speculative.

In a conventional set of golf clubs, all the irons, as well as woods, have a matched swing weight. Swing weight and total weight are two club fitting variables that interrelate and are best determined for a proper fit when they are analyzed along with a number of other golf club variables. Swing weight is the measurement of the golf club weight distribution (grip, shaft, and head) about a fulcrum point which is established at a specified distance from the grip end of the club. Several different standards exist for measuring this swing weight. The most common are the official swing weight which uses a 12 inch fulcrum distance and the lorythmic swing weight which uses a 14 inch fulcrum distance. In the conventional set of clubs, the clubs are designed so that the swing weight is the same for each club. In order to keep the swing weight the same for each club, the total weight of each club is different as dictated by the different shaft lengths and head weights of the clubs. The validity of matched swing weights has often been questioned. However, matched swing weights have been accepted in the market and generally connote a higher quality to the consumer. Thus, for a constant swing weight, the total weight will be determined by the individual's component selection and the club's length. In order for a set of clubs to have the same swing weight, as each club gets shorter, more weight must be added to the head to maintain the swing weight for club balance. Since the individual components such as grips and shafts vary in weight due to normal manufacturing tolerances, and also the fact that so many different types and styles are available, it is hard to control the exact incremental difference in total weight between clubs. As a rule of thumb, their difference is approximately 3/16 to ¼ ounce decrease in total weight as each succeeding club is longer by ½ inch. Table I (Prior Art) shows a list of conventional clubs.

Total weight alone has no effect on swing weight. How a golf club's total weight is distributed determines the balance of that club and its swing weight. For example, the weight of a 13 ounce driver must be increased ¾ ounce without changing its swing weight simply by adding ½ ounce weight in the grip and ¼ ounce in the head of the club. This is called counter balancing. U.S. Pat. Nos. 1,658,447; 1,696,462; 1,210,182; and 4,461,479 disclose various methods for adding weight to the grip of a golf club in order to balance the club.

Accordingly, an important object of the present invention is to provide a set of golf clubs which may be played with a constant swing yet provide a range of distances comparable or greater than a conventional set of clubs.

Another object of the invention is to provide a set of golf clubs which may be played with a common address to the ball and consistent repeated swing, yet which are designed for different club head speeds for a wide range of distances.

Another important object of the present invention is to provide a matched set of golf clubs which can be played with a consistent repeated swing for the woods and irons wherein at least the iron set includes a plurality of subsets each having a common, constant swing with each other, but variations in other club characteristics, similar to a conventional golf club set.

SUMMARY OF THE INVENTION

The above objectives are accomplished according to the above invention by providing a set of golf clubs having a wood set and an iron set in which the irons set has different subsets within the set. The heads of the clubs in the irons set may be generally the same size and shape, weight, and mass. The only difference that distinguishes the club heads of all the irons from one another will be the loft angle. The length of the shaft of the irons will vary from one subset to the other. However, all the irons will be gripped at a common grip line at the same length from the club head for a common ball address stance and swing. The handle end of the irons in the different subsets will have different lengths above the top hand which include a counterweight. The longer club will have a heavier counterweight and the shorter club will have a lighter counter-weight so that the club head speed of the longer clubs will be greater and result in hitting the ball a longer distance. Since the golfer will grip all of the irons the same distance from the club head, the player will be at generally the same distance or location from the ball on each swing. All the irons can be played with a repeated consistent and common swing. The longer shaft lengths and heavier counterweights of the longer irons, i.e. 2, 3, 4 will enable the ball to be hit further due to the increased energy imparted to the ball. Since the golfer stands at the same distance and closer to the ball for all of the irons, more control is had over hitting the ball at the center spot on the club face. In this manner, the loft and the variations of the velocity of the club heads will provide a full range of ball distances for the set of clubs.

The loft angles and club head speeds of the clubs in the set will produce a range of distances equal to or greater than a conventional set of clubs. The shortened club shafts on the longer irons enable the average golfer to play better shots. Better control will be had so that more accurate hitting of the ball at the center spot of the club face will be had which may be just as significant as the club head speed in determining distance. While the loft angle changes, the vertical height of the irons remains the same so the same face presentation is made to the club, and at a same vertical hand height for a uniform address.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 2 is an elevation illustrating a set of woods constructed in accordance with the present invention;

FIG. 3 is a schematic view illustrating the lie angle of golf clubs constructed in accordance with the present invention;

FIG. 6 is an elevation illustrating a golf club having an offset club head in accordance with the invention;

DESCRIPTION OF A PREFERRED EMBODIMENT

Figure 1:
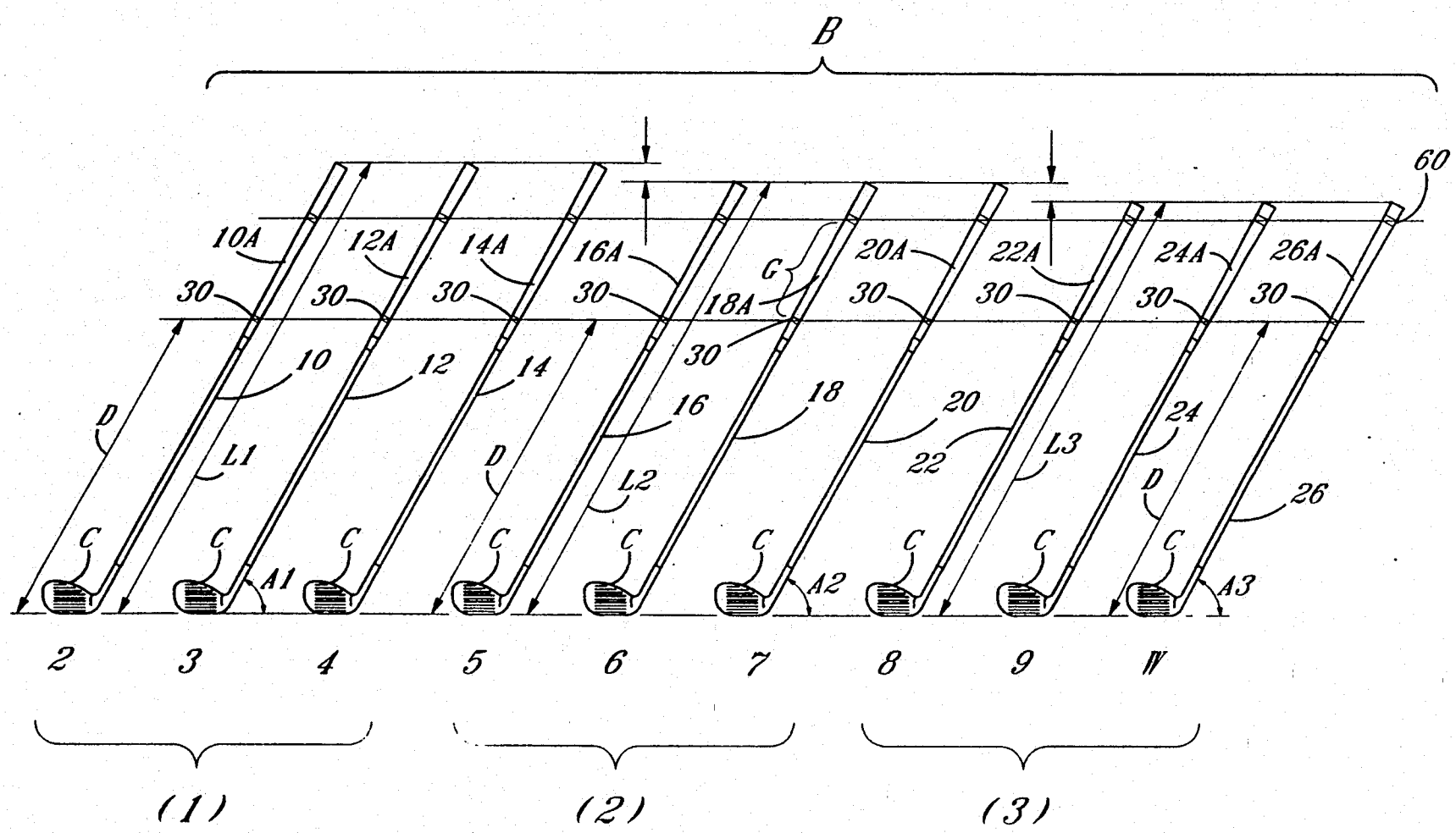
FIG. 1 is a front elevation illustrating a set of irons having multiple subsets constructed in accordance with the present invention.
Figure 4:
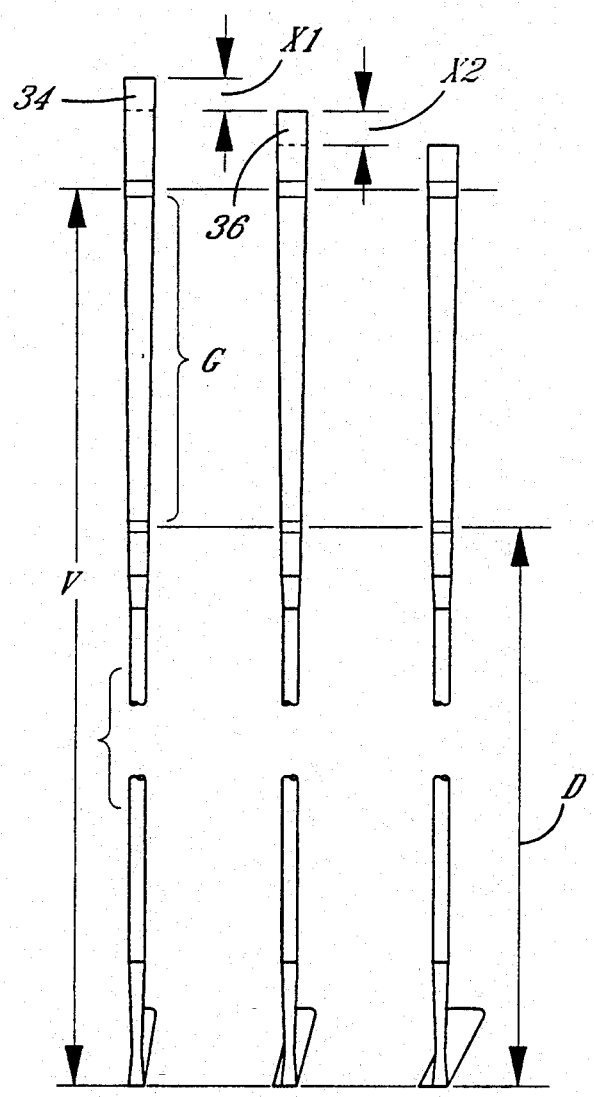
FIG. 4 is a front elevation illustrating plural subsets of a set of irons constructed in accordance with the present invention.

Referring now to the drawings, the invention will be described in more detail. A set of golf clubs is disclosed which includes a first set A of clubs that are woods, as can best be seen in FIG. 2, and a second set B of clubs which are irons, as can best be seen in FIG. 1. Iron set B further includes multiple subsets of irons which have clubs that are matched and correlated with each other and to the irons in the other subsets. There is a subset 1, a subset 2, and a subset 3, as can best be seen in FIG. 1.

Referring first to set B of irons, all the irons have a club head with a different loft angle that corresponds generally to the same loft angle as a conventional iron designated by a like club number. Reference may be had to Tables I and II for this comparison, as well as the following comparisons to be made. Loft angle is the only club parameter which is commonly different among all the irons. Each subset has a unique club length which is different from the club lengths in the other subsets. For example, as can best be seen in FIG. subset 1 includes the clubs 10, 12, 14 corresponding to numbered irons 2, 3, and 4 which have a length L1. Subset 2 includes clubs numbered 16, 18, 20 corresponding to irons 5, 6, and 7 which have a shortened length L2. Subset 3 includes clubs 22, 24, 26 corresponding to numbered irons 8, 9, and W which have a shaft length L3 which is shortened over that of subset 2 and subset 1. In accordance with the preferred embodiment illustrated, there is a difference of ½ inch between each subset as they progressively become shortened. It will be readily noted, of course, that the irons within the subsets all have the same length. All of the irons in set B have a club head C which is identical except for the loft angle. That is, the club head weight, mass, and size and shape are generally the same. Thus, the golfer will see a uniform club head no matter which iron he is swinging adding to his confidence. No longer will the club head of the longer irons, i.e. the number 2 iron, appear smaller than the club head of the shorter irons like the number 9 iron. While any suitable club head shape may be utilized as long as they are uniform, the shape of a conventional 7 iron club head is preferred.

All the irons in set B have a common grip line 30, a grip line 30 is visibly marked on the grip 10*a*–26*a* of each iron 10–26 in subsets 1, 2, and 3. Grip line 30 is defined by the distance "d" between the grip line and the base of the club head C of the club, as can best be seen in FIG. 5. The distance "d" will be the same for all the irons in subsets 1, 2, and 3 of set B. Thus, the golfer will have generally the same address and stance at the ball for all the irons in set B. As a result, the grip handles 10*a*, 12*a*, and 14*a* of irons 10–14 will extend above the top hand of the golfer more than the grip handles of subsets 2 and 3 of the irons. The grips 16*a*–20*a* of clubs 16–20 of subset 2 will extend slightly more above the top hand than the irons of subset 3, etc. In this extra length of the grip above the golfer's top hand, it is contemplated that a counterweight is included to increase the speed of the club head of the longer irons for distance. This compensates for the shortened shaft for the longer irons. Theoretically, the club head travels faster at impact with a longer shaft. This counterweight compensates for any loss of club head speed and, in fact, should speed up the club head so that the iron may hit the ball further than with a corresponding conventional club. Preferably, in the space X1 of the longer irons 10–12, a counterweight of 1 ounce (28 grams) is disposed in each club. In the space X2 in the grips 16*a*–20*a* of irons 16–20 accommodates a counterweight of ⅔ ounce (18.9 grams) for the clubs. The shorter clubs 22, 24, and 26 of subset 3 will have a counterweight of ⅓ ounce (9.45 grams), as can best be seen in Table II.

Even though the actual lie angle of the club heads C is not physically altered by the longer club shafts of the subsets, a player playing the clubs from the ends of the grip might notice a slight difference in the lie angle of the head. For example, if the golfer moved his hands away from the grip line on the longer clubs of subset 1, the lie may be more upright as can best be seen in the dotted line position of FIG. 3. This may result in a different actual play lie angle for the clubs if gripped at the ends as is usual with a conventional set of clubs. However, by gripping the club about the grip line, the irons in the subsets will have an effective equal lie.

All the clubs in set B have a different loft angle, and have the same swing weight and club head (generally same size and shape, and weight).

Referring now to each subset 1, 2, and 3, each of which is unique in regards to the other, these features will now be described. As can best be seen in FIG. 1 and in Table II, irons 10, 12, and 14 within subset 1 (iron numbers 2, 3, and 4) each have the same shaft length, total weight, lie angle al, and counterweight. Irons 16, 18, and 20 within subset 2 (iron numbers 5, 6, and 7) have the same shaft length, total weight, lie angle a2, and counterweight which are uniquely different from subset 1. Irons 22, 24, and 26 within subset 3 (iron numbers 8, 9, and W) have the same shaft length, total weight, lie angle a3, and counterweight which are different from the subsets 1 and 2. Of course, the head weights and swing weights are commonly the same among the subsets. Thus, the only common characteristics of all the irons in set B are the club head weight and swing weight. Preferably, lie angles a1, a2, a3 are the same for all the irons. The only commonly different characteristic of all the irons is the loft angle. The shaft length, total weight, and counterweight are unique to each subset. While the swing weights are illustrated as being equal, it may also be possible that they are not. For example, with the same size and weight of the club heads, different counterweights may be placed at the ends of the club altering the swing weight. However, the longer irons which may contain more counterweights, will swing lighter so that the club head speed is faster. By gripping the club around the standard grip line, the club will move even faster with the control needed by the short consistent swing. The same characteristics are also reflected in Table III which show a preferred embodiment wherein the lie of the woods and irons is different to provide the same vertical hand height as will be more fully explained.

Figure 12:
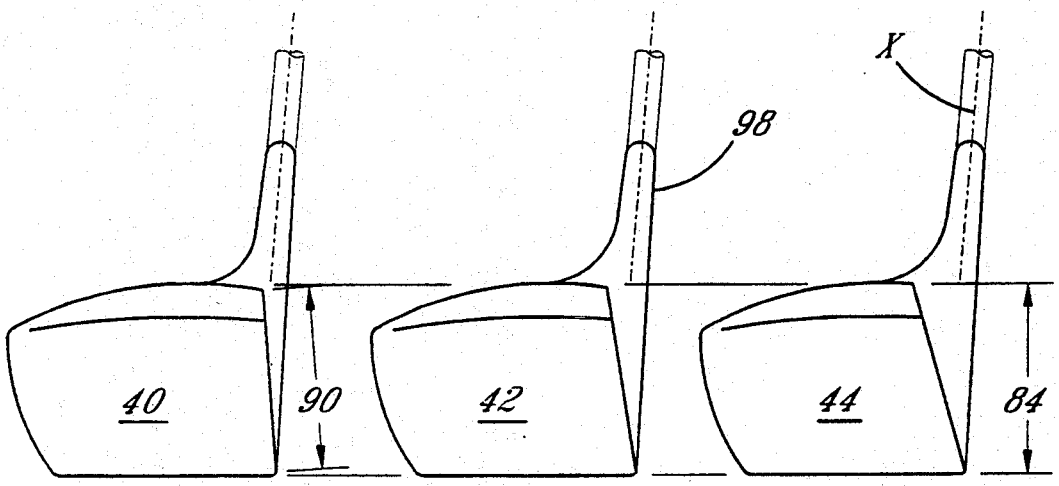
FIG. 12 is an end view of a number of wood clubs according to the invention wherein the clubs have a same vertical height.
Figure 13:
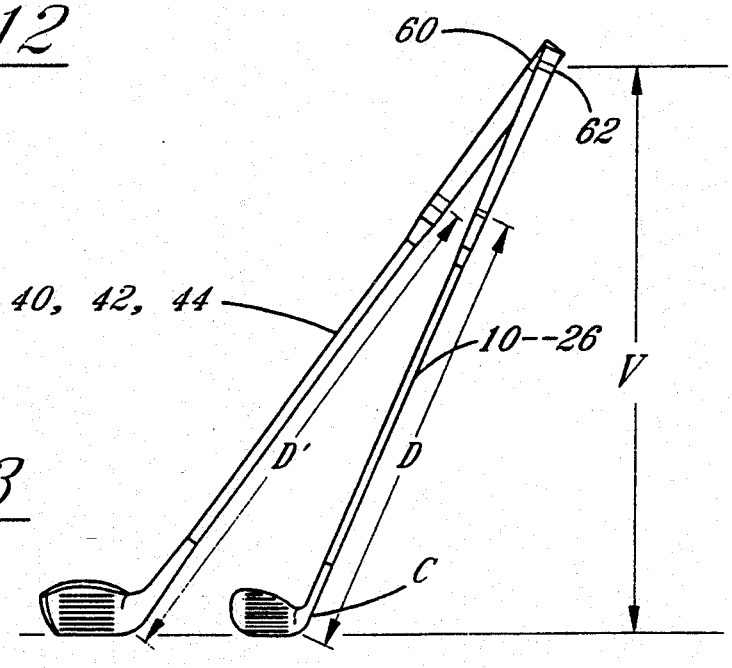
FIG. 13 is a front elevation illustrating wood clubs and iron clubs according to the invention wherein all the clubs have a same vertical hand height which is equal as defined by vertical distance between horizontal to a top grip line and a horizontal to a sole of the club in its address position.

Referring now to FIGS. 2 and 12, set A of clubs includes woods 40, 42, and 44, corresponding to the 1, 3, and 5 woods. Again, as can best be seen in Table II, each wood has a different length of ¼ inch resulting in the lengths illustrated. Each wood has a different total weight, different loft angle, and different counterweight. Each wood has the same swing weight, head weight, lie angle, and common grip line 46. The distance d1 from the club head will the same for each wood so that the golfer may address the ball from a similar position for each wood and have a consistent and common swing for each wood. The distance the ball travels will vary due to the different counterweight in the handle and loft angle of the head. If hit correctly in the center spot, the ball will go further due to the increased velocity of the club head caused by the counterweight. However, a shortened shaft will be used where more control will be had over the club. Thus, for more control, it is more likely that the ball will be hit accurately and with additional velocity so that longer distances may be achieved than with conventional woods.

TABLE I

| | Length (inches) | Total Weight (ounces) | (Prior Art) Lie (degrees) | Head Weight (grams) | Swing Weight (ounces) | Loft (degrees) |
|---|---|---|---|---|---|---|
| Woods | | | | | | |
| 1 | 43 | 13.1 | 55 | 200 | 20.52 | 10 |
| 3 | 42 | 13.5 | 56 | 214 | 21.50 | 16 |
| 5 | 41 | 14.1 | 57 | 221 | 21.50 | 22 |
| Irons | | | | | | |
| 2 | 39 | 14.7 | 56 | 254 | 21.60 | 20 |
| 3 | 38½ | 15.1 | 57 | 261 | 21.60 | 24 |
| 4 | 38 | 15.3 | 58 | 268 | 21.60 | 28 |
| 5 | 37½ | 15.5 | 59 | 275 | 21.60 | 32 |
| 6 | 37 | 15.7 | 60 | 282 | 21.60 | 36 |
| 7 | 36½ | 16.1 | 61 | 289 | 21.60 | 40 |
| 8 | 36 | 16.3 | 62 | 296 | 21.60 | 44 |
| 9 | 35½ | 16.5 | 63 | 303 | 21.60 | 48 |
| W | 35½ | 16.5 | 63 | 320 | 21.60 | 52 |

TABLE II

| | Length (inches) | Total Weight (ounces) | Lie (degrees) | Head Weight (grams) | Swing Weight (ounces) | Loft (degrees) | Counter Balance (grams) | (ounces) |
|---|---|---|---|---|---|---|---|---|
| Woods | | | | | | | | |
| 1 | 41½ | 15.0 | 53 | 260 | 22 | 10 | 28.35 | 1 |
| 3 | 41½ | 14.7 | 53 | 260 | 22 | 16 | 18.90 | ⅔ |
| 5 | 41 | 14.4 | 53 | 260 | 22 | 22 | 9.45 | ⅓ |
| Irons | | | | | | | | |
| 2 | 37½ | 17.8 | 53 | 303 | 22 | 18 | 28.35 | 1 |
| 3 (1) | 37½ | 17.8 | 53 | 303 | 22 | 22 | 28.35 | 1 |
| 4 | 37½ | 17.8 | 53 | 303 | 22 | 26 | 28.35 | 1 |
| 5 | 37 | 17.0 | 53 | 303 | 22 | 30 | 18.90 | ⅔ |
| 6 (2) | 37 | 17.0 | 53 | 303 | 22 | 34 | 18.90 | ⅔ |
| 7 | 37 | 17.0 | 53 | 303 | 22 | 38 | 18.90 | ⅔ |
| 8 | 36½ | 16.2 | 53 | 303 | 22 | 42 | 9.45 | ⅓ |
| 9 (3) | 36½ | 16.2 | 53 | 303 | 22 | 46 | 9.45 | ⅓ |
| W | 36½ | 16.2 | 53 | 303 | 22 | 50 | 9.45 | ⅓ |

TABLE III

| | Length (inches) | Total Weight (ounces) | Lie (degrees) | Head Weight (grams) | Swing Weight (ounces) | Loft (degrees) | Counter Balance (grams) |
|---|---|---|---|---|---|---|---|
| Woods | | | | | | | |
| 1 | 40.4 | 15.0 | 46 | 227 | 22 | 10 | 31.5 |
| 3 | 39.9 | 14.7 | 46 | 227 | 22 | 16 | 19.0 |
| 5 | 39.4 | 14.4 | 46 | 227 | 22 | 22 | 6.5 |
| Irons | | | | | | | |
| 2 | 36 | 17.8 | 53 | 270 | 22 | 18 | 31.5 |
| 3 (1) | 36 | 17.8 | 53 | 270 | 22 | 22 | 31.5 |
| 4 | 36 | 17.8 | 53 | 270 | 22 | 26 | 31.5 |
| 5 | 35½ | 17.0 | 53 | 270 | 22 | 30 | 19.0 |
| 6 (2) | 35½ | 17.0 | 53 | 270 | 22 | 34 | 19.0 |
| 7 | 35½ | 17.0 | 53 | 270 | 22 | 38 | 19.0 |
| 8 | 35 | 16.2 | 53 | 270 | 22 | 42 | 6.5 |
| 9 (3) | 35 | 16.2 | 53 | 270 | 22 | 46 | 6.5 |
| W | 35 | 16.2 | 53 | 270 | 22 | 50 | 6.5 |

As can best be seen in FIG. 6, woods 40, 42, 44 have a club head 50. While club head 50 is shown offset relative to shaft 52 in FIG. 6, it is preferred that the leading edge of the face of the club head be in line with the outside diameter of the hosel, as can best be seen in FIG. 12. Club heads for woods 40, 42, and 44 are preferably made from metal.

Figure 5:
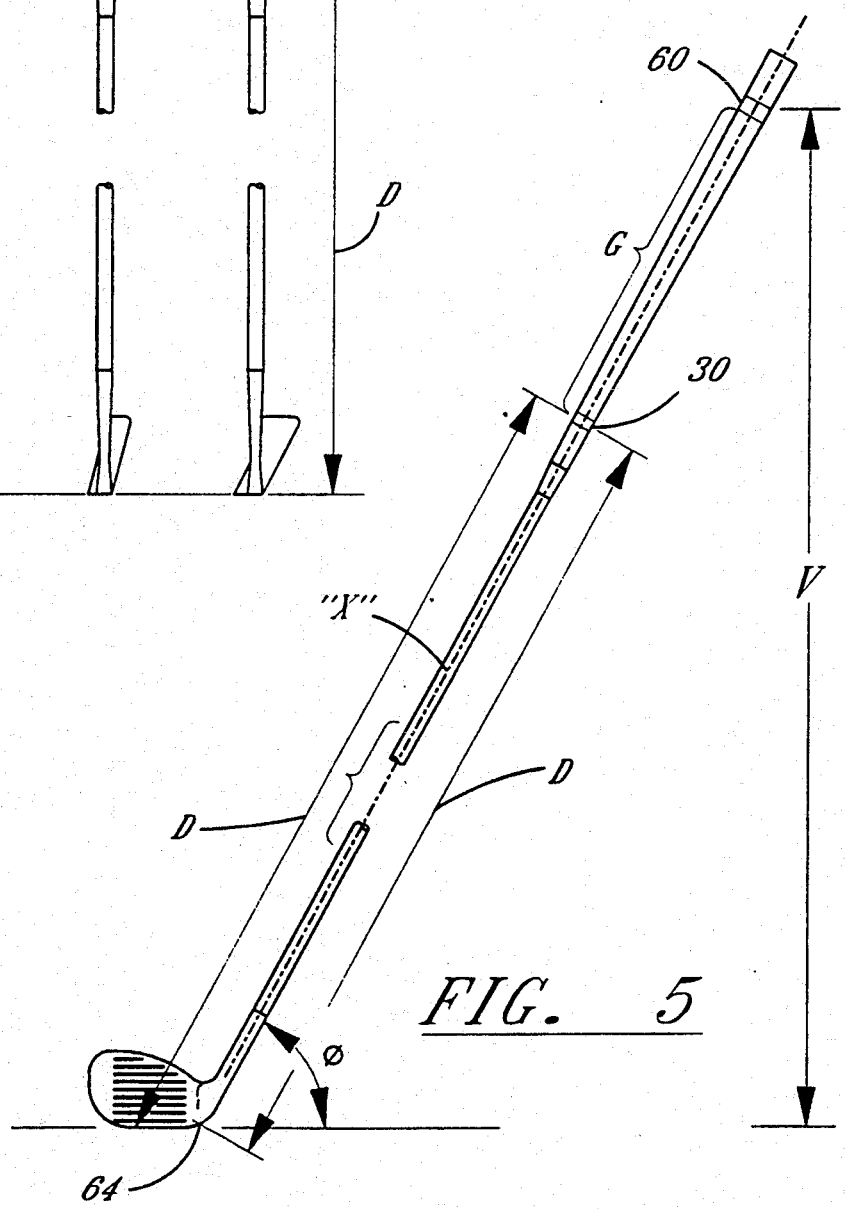
FIG. 5 is a side elevation illustrating a golf club constructed in accordance with the present invention.

FIGS. 7–13 show further refinements of the invention wherein there is a common grip "G" about which all the clubs are gripped defined by bottom grip line 30 and a top grip line 60, in regards to the irons, as can best be seen in FIG. 5; and in regards to woods is defined by bottom grip line 46 and top grip line 62. There is a vertical distance "V" between the horizontal to the sole of the head of the golf club in the address position, and a horizontal through the top grip line 60, 62 of the clubs which is the effective vertical hand height for playing of the clubs. Alternatively, vertical distance "V" may be measured as that distance between a first line drawn parallel with the sole of the golf club and a second line, parallel to the first line, drawn through top grip line 60 or 62. Top grip line 60 corresponds generally to the position of the top of the hand when the hand is gripped about grip "G". As clearly seen in FIGS. 1 and 2 top grip line 60, 62 for each golf club is spaced an equal distance above grip line 30, 46. The vertical distance "V" is the same for all the irons and woods according to the invention. The distance "V" may depend on the length of the clubs. In accordance with the illustrated set of clubs, the preferred vertical distance "V" is about 28¼ inches. However, this distance may vary in a range of about 6 inches depending upon the length of the clubs. This means that while the individually numbered woods may have different actual lengths, as can best be seen in Table III, they all have the same effective length, i.e. d'=38.9 inches; and while the irons of the different subsets have 3 different actual lengths, all the irons in the subsets have the same effective length, i.e. d=34½ inches, as can best be seen in FIG. 13. As can best be seen in FIG. 5, the distance "d", heretofore defined, is the distance from the sole of the club to bottom grip line 30, is best measured from the intersection 64 of club sole and the axis "X" of the shaft. The club head is in the address position with the sole grounded and the scorelines on the, face generally parallel to the ground. While the distance "d'" is different for the woods is a different length than the distance d for the irons, the distance "V" is the same for the woods and the irons. This is due to the different lie of the woods, i.e. 46°, and irons, i.e. 53° as can best be seen in Table III.

Figure 7:
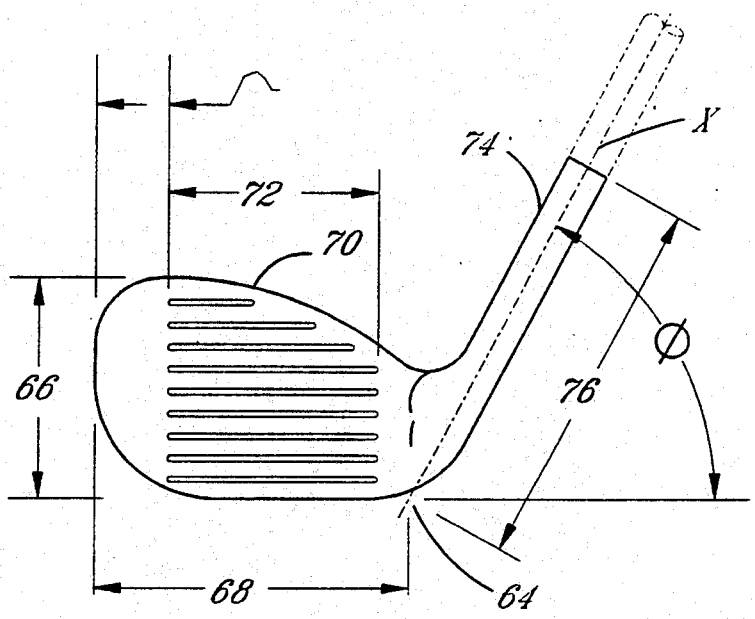
FIG. 7 is a front elevation of a face of an iron club according to the invention in an address position.
Figure 8:
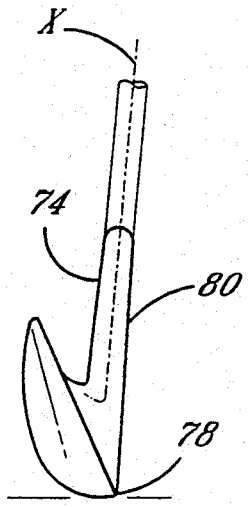
FIG. 8 is an end view of the iron club of FIG. 7.
Figure 9:
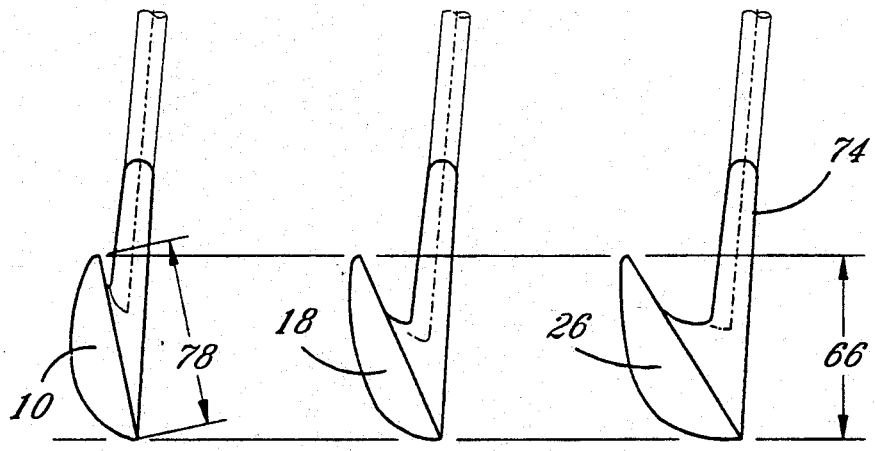
FIG. 9 is an end view illustrating golf clubs constructed according to the invention wherein the irons have a same vertical height.

Preferably, the faces of the iron club heads have the same vertical height 66, and the same face length 68, as can best be seen in FIGS. 7–9. Score lines 70 on the face of the irons have a width of 72. The hosel length as measured from the intersection 64 to the top of the hosel 74 is denoted at 76, and is the same for all the irons. As can best be seen in FIG. 9, all of the irons have the same vertical length 66, but a different face width 78. The face width 78 will be different for each of the irons in the set of the individually numbered irons 2–9, and including the wedge, in accordance with the loft of the numbered irons. However, since the vertical height 66 is the same for all the irons, the face presented to the ball at address will be the same regardless of the number of the iron, i.e. each iron will leave the same face impression if hit into a snow or sand bank. The center of mass stays generally the same and below the center of the face.

As can best be seen in FIG. 8, the leading edge 78 of the face of all the irons is in line with the forward edge 80 of the diameter of the hosel 74. Thus, the leading edge of the face and the hosel are in line with one another.

Figure 10:
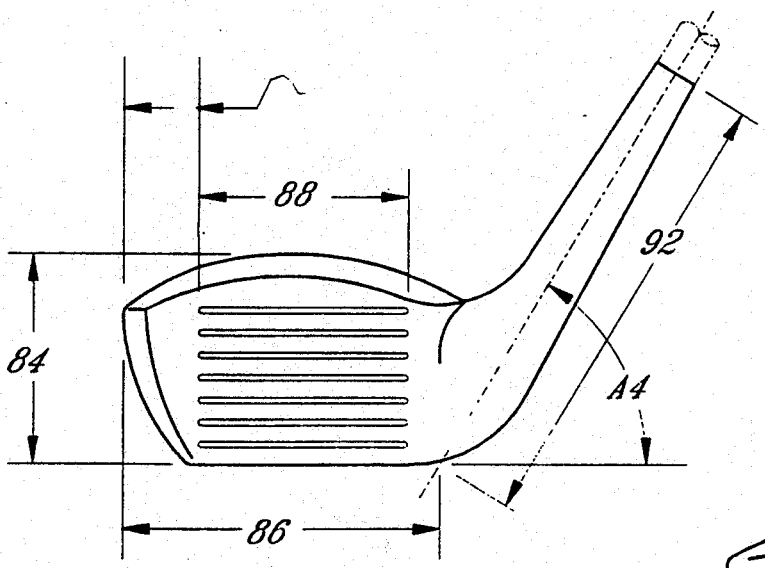
FIG. 10 is a front elevation of the face of a wood club in an address position according to the invention.
Figure 11:
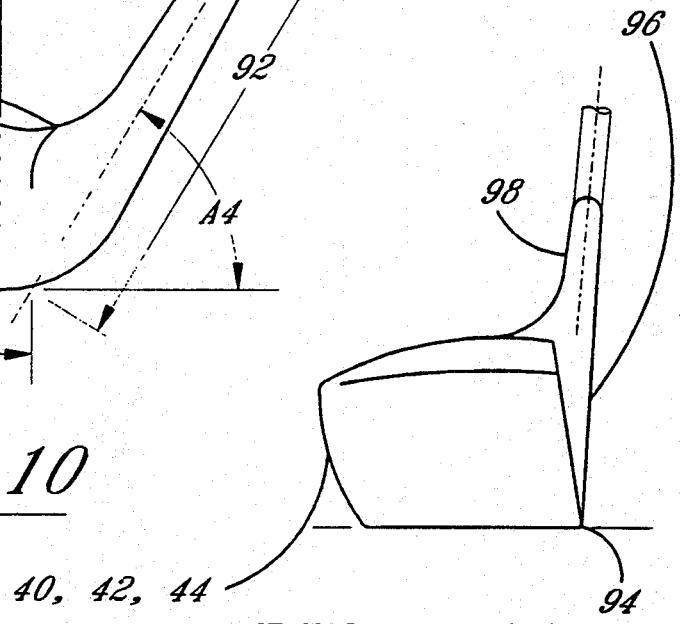
FIG. 11 is an end view of the wood club of FIG. 10.

As can best be seen in FIGS. 10–12, the woods in the set of clubs according to the invention, all have a vertical height of 84 and hosel length which is equal for all the wood clubs. The clubs have a face length 86 which is generally equal and a scoreline width 88 which is equal. However, the face width 90 of the face of the wood clubs will vary dependent upon the number of the club, i.e. the loft of the club, as can best be seen in FIG. 12. As in the case of the irons described above, all the faces of the woods will have the same presentation to the ball. The wood club head has a hosel 92, and as can best be seen in FIG. 11, a leading edge 94 of the wood club face is in line with the forward edge 96 of hosel 98.

The set and subset of clubs described in FIGS. 7–13 are more fully described by reference to Table III wherein an example of the various features of a preferred embodiment of the invention are set forth. The counterweights may be provided by the actual inclusion of weight in the handle or grip, or, in some applications, by different handle lengths above top grip lines.

Thus, it can be seen that a highly advantageous set of golf clubs can be had in accordance with the present invention wherein the set of woods and set of irons may be each played with a consistent swing wherein the clubs are relatively shortened for better control, yet without decrease in distance. In particular, the set of irons includes subsets of irons wherein the clubs within each subset have similar characteristics, yet the clubs of the different subsets have differing characteristics to provide the result of a consistent common swing for each club, yet with a full range of distances.

While a preferred embodiment of the invention has been described using specific terms, such description is for illustrative purposes only, and it is to be understood that changes and variations may be made without departing from the spirit or scope of the following claims.

What is claimed is:

1. A set of golf clubs designed for a generally common golf swing and a full range of ball distances:

said set of clubs includes individually numbered wood clubs each having a club head with a sole, a shaft having a handle grip and a first lie angle, a set of individually numbered iron clubs each having a club head with a sole a shaft having a handle grip and a second lie angle, each of said club heads has a unique loft angle which is different from the loft angle of the other of said club heads;

said first lie angle of said wood clubs is different from said second lie angle of said iron clubs;

said wood clubs have a first top hand grip line on said handle grips adjacent which said wood clubs are gripped by a golfer in an address position, said top hand grip line is defined by a first distance from said sole of said wood club head along said shaft to said first top hand grip line;

said iron clubs also having a second top hand grip line on said handle grips adjacent which said iron clubs are gripped by said golfer in an address position said second hand grip line is defined by a second distance from said sole of said iron club heads along said shaft to said second grip line;

said first distance of said first top hand grip lines of said wood clubs is different from said second distance of said second top hand grip lines of said iron clubs;

a vertical hand height defined as a distance between a first line drawn tangentially of and parallel to said sole of said iron clubs and said wood clubs and a second line, which is parallel said first line and drawn through said top hand grip line, said distance of said vertical hand height being generally equal for both said wood clubs and said iron clubs of said set of golf clubs.

2. The set of claim 1 wherein all said iron clubs have club heads which are of substantially one vertical height so that the same face presentation is made by all said iron clubs in an address position.

3. The set of claim 1 wherein said wood clubs each have equal vertical height and equal face lengths so that a single face presentation to the ball is made by all said wood clubs in address position, and said faces of said wood clubs have widths that are different from each other presenting different loft angles.

4. The set of claim 1 wherein regulating counterweights of differing weight are secured near free ends of said handle grips of sad set of golf clubs said counter weights being correlated to said numbered iron clubs and wood clubs so that said iron clubs and wood clubs may be gripped adjacent said top hand grip line and swung with generally the same swing, stance, and relative position to the ball to produce a full range of ball distances with increased control.

5. The set of claim 1 wherein said first lie angle is smaller than said second lie angle.

6. The set of claim 1 wherein said iron clubs are arranged in subsets each of said iron clubs within a subset having regulating counterweights secured near said free end of said grip handle which are equal; and said iron clubs in different subsets have regulating counterweights which are different in weight from the counterweights of the other subsets.

7. The set of claim 1 wherein all of said iron clubs have club heads of generally the same weight.

8. The set of claim 1 wherein said wood clubs are of equal vertical height, face length, and lie angle, so that the face presentation made to the ball is the same by all said wood clubs in an address position, and said wood clubs further having face widths that are different from each other with different loft angles.

9. The set of claim 8 wherein each of said wood clubs has a total weight which is different from the other of said wood clubs.

10. The set of claim 1 wherein said wood clubs have counterweights of different weights secured near said free end of said handle grips.

11. The set of claim 10 wherein each of said wood clubs is of a length different from the other of said wood clubs.

12. The set of claim 1 wherein said golf clubs include faces having leading longitudinal edges which are aligned with an outside diameter of a hosel of said golf clubs.

* * * * *